US012012565B2

(12) United States Patent
Kocsis et al.

(10) Patent No.: US 12,012,565 B2
(45) Date of Patent: Jun. 18, 2024

(54) WAX ANTI-SETTLING ADDITIVE COMPOSITION FOR USE IN DIESEL FUELS

(71) Applicant: The Lubrizol Corporation, Wickliffe, OH (US)

(72) Inventors: Jody A. Kocsis, Chagrin Falls, OH (US); Scott Capitosti, Perry, OH (US); Thomas S. Corrigan, Lakewood, OH (US); David J. Aaserud, Painesville, OH (US); Gregory Mathes, Streetsboro, OH (US); Anthony R. Frank, Painesville, OH (US); Elizabeth A. Schiferl, St. Paul, MN (US); James C. Ray, Sevierville, TN (US)

(73) Assignee: The Lubrizol Corporation, Wickliffe, OH (US)

( * ) Notice: Subject to any disclaimer, the term of this patent is extended or adjusted under 35 U.S.C. 154(b) by 84 days.

(21) Appl. No.: 17/787,539

(22) PCT Filed: Oct. 1, 2020

(86) PCT No.: PCT/US2020/053804

§ 371 (c)(1),
(2) Date: Jun. 20, 2022

(87) PCT Pub. No.: WO2021/126342

PCT Pub. Date: Jun. 24, 2021

(65) Prior Publication Data

US 2022/0389341 A1 Dec. 8, 2022

Related U.S. Application Data

(60) Provisional application No. 62/950,176, filed on Dec. 19, 2019.

(51) Int. Cl.
*C10L 10/14* (2006.01)
*C10L 1/198* (2006.01)
(Continued)

(52) U.S. Cl.
CPC ..... *C10L 1/2222* (2013.01); *C10L 1/1981* (2013.01); *C10L 1/2387* (2013.01); *C10L 10/14* (2013.01);
(Continued)

(58) Field of Classification Search
CPC ..... C10L 1/10; C10L 1/1641; C10L 1/1832; C10L 1/196; C10L 1/1973; C10L 1/1981;
(Continued)

(56) References Cited

U.S. PATENT DOCUMENTS

| | | | | |
|---|---|---|---|---|
| 8,968,428 | B2 | 3/2015 | Siggelkow et al. | |
| 2012/0010112 | A1* | 1/2012 | Grabarse | C10L 10/00 508/519 |
| 2013/0133243 | A1 | 5/2013 | Roeger-Goepfert et al. | |

FOREIGN PATENT DOCUMENTS

| | | | | |
|---|---|---|---|---|
| EP | 0857776 | | 8/1998 | |
| WO | 1999/061562 | | 12/1999 | |
| WO | WO-9961562 | A1 * | 12/1999 | C10L 1/143 |

* cited by examiner

*Primary Examiner* — Ellen M McAvoy
*Assistant Examiner* — Chantel Graham
(74) *Attorney, Agent, or Firm* — Iken S. Sans; Michael A. Miller

(57) ABSTRACT

A composition comprising at least one fuel that is a diesel fuel, a biodiesel fuel, or combinations thereof and less than 100 ppm, less than 50 ppm (or less than 25 ppm, less than 10 ppm, 1 to 7 ppm, or 5 to 7 ppm) of an alkylene-coupled $C_{10}$ to $C_{60}$ (or $C_{10}$ to $C_{40}$, $C_{14}$ to $C_{32}$ or $C_{24}$ to $C_{28}$) alkylphenol; 25 to 500 ppm (or 50 to 500 ppm, or 150 to 450 ppm or 250 to 450 ppm, or 250 to 400 ppm) of a terpolymer; and 5 to 90 ppm, (or 10 to 70 ppm, to 60 ppm, or 10 to 55 ppm) of hydrocarbyl-substituted amine detergent having at least one tertiary amino group.

Methods of reducing the cold filter plugging point ("CFPP") of a fuel, said method comprising adding the following
(Continued)

components: less than 100 ppm, less than 50 ppm (or less than 25 ppm; less than 10 ppm, 1 to 7 ppm, or 5 to 7 ppm) of an alkylene-coupled $C_{10}$ to $C_{60}$ (or $C_{10}$ to $C_{40}$, $C_{14}$ to $C_{32}$ or $C_{24}$ to $C_{28}$) alkylphenol; 25 to 500 ppm (or 50 to 500 ppm, or 150 to 450 ppm or 250 to 450 ppm, or 250 to 400 ppm) of a terpolymer; and 5 to 90 ppm, (or 10 to 70 ppm, to 60 ppm, or 10 to 55 ppm) of hydrocarbyl-substituted amine detergent having at least one tertiary amino group.

Uses of a fuel additive composition to reduce the cold filter plugging point ("CFPP") of a fuel, wherein the fuel additive composition comprises: 0.2 to 3 wt % of an alkylene-coupled $C_{10}$ to $C_{60}$ (or $C_{10}$ to $C_{40}$, $C_{14}$ to $C_{32}$ or $C_{24}$ to $C_{28}$) alkylphenol; 10 to 50 wt % of a terpolymer; and 2 to 10 wt % of hydrocarbyl-substituted amine detergent having at least one tertiary amino group; and an optional solvent.

18 Claims, 2 Drawing Sheets

(51) Int. Cl.
*C10L 1/222* (2006.01)
*C10L 1/2387* (2006.01)

(52) U.S. Cl.
CPC ..... *C10L 2200/0446* (2013.01); *C10L 2200/0476* (2013.01); *C10L 2270/026* (2013.01)

(58) Field of Classification Search
CPC ..... C10L 1/2222; C10L 1/224; C10L 1/238; C10L 1/2383; C10L 1/2387; C10L 10/14; C10L 10/16; C10L 2200/0446; C10L 2200/0476; C10L 2270/026; A61K 2039/505; A61K 38/00; A61K 39/0011; A61P 35/00; C07K 16/065; C07K 16/2863; C07K 16/32; G01N 33/57484
See application file for complete search history.

WAX ANTI-SETTLING ADDITIVE COMPOSITION FOR USE IN DIESEL FUELS

FIELD OF THE INVENTION

The disclosed technology relates to compounds that are useful as wax anti-settling additives in diesel fuels. In particular, diesel fuel compositions and concentrates comprising wax anti-settling agent compositions and the use of such compositions are disclosed.

BACKGROUND OF THE INVENTION

Under cold temperature conditions, diesel fuels are known to form semi-crystalline wax particles that cause clouding of the fuel. These wax particles are generally formed from normal paraffins and other waxy components that may be present in the fuel. As diesel fuel is cooled, it may eventually reach the cloud point ("CP"). CP is the temperature at which the paraffin wax falls out of solution and starts to form wax crystals. The CP can be measured using American Society for Testing and Materials ("ASTM") methods D5773 or D5771.

The wax crystals that are formed may affect the fluidity or transferability of the liquid fuel in multiple ways thereby causing problems pumping the fuel or even in engine performance. One way is when the wax forms a matrix within the fuel such that, although the fuel is not frozen solid, the bulk fuel is prevented from flowing because it is held within the crystal matrix. The pour point ("PP") is the temperature at which the fuel begins to lose its flow characteristics and can be measured using ASTM D5949, D5950 or D97.

Another way the transferability can be affected is at temperatures below the CP. The wax crystal build-up can lead to precipitation of solid wax particles which can inhibit the flow of fuel through the fuel filter, commonly referred to as the cold filter plugging point ("CFPP"). The CFPP can be measured using ASTM D6371 and is the lowest temperature at which a given volume (about 45 ml) of diesel will no longer pass through a 45-micron filter within the time allotted in the method. This method is intended to simulate the flow of cold fuel through a diesel engine's fuel system. The CFPP is usually at some temperature between the CP and the PP.

Additional problems can occur when diesel is stored in cold weather. Wax crystals may agglomerate in the bottom layer of the storage tank. This makes the cold properties between the upper and bottom layers of the stored diesel uneven. Diesel fuel additives known as wax anti-settling additives ("WASA") can be added to prevent wax settling in the bulk fuel. WASA are thought to work by disrupting the formation of wax crystals, making the wax crystals smaller and thereby preventing the buildup of solid wax and lowering the CFPP. WASA can modify the wax crystals of the diesel fuel and reduce their size drastically. Smaller wax crystals may hardly settle and pass through fuel filters more easily, thus extending the fluidity and transferability of the fuel to a lower temperature. The use of WASA can also prevent wax from settling when diesel is transported during the winter. This enables the discharge of the fuel from the transport tanker into a storage tank.

Known WASA include a combination of polyacrylates, formaldehyde coupled phenols, and the condensation products of aliphatic fatty amines, alkylsuccinimides, phthalimides, and glutarimides with carbonyl compounds.

SUMMARY OF THE INVENTION

The disclosed technology provides a novel composition comprising a fuel with wax anti-settling additives ("WASA") that has a lower cold filter plugging point ("CFPP") than the unadditized fuel. The composition comprises a fuel and a mixture of at least 3 different components, an alkylene-coupled $C_{10}$ to $C_{60}$ alkylphenol, a terpolymer, and a hydrocarbyl-substituted amine detergent having at least one tertiary amino group. The fuel may be a diesel fuel, a biodiesel fuel, or combinations thereof.

In some embodiments, the alkylene-coupled $C_{10}$ to $C_{60}$ (or $C_{10}$ to $C_{40}$, $C_{14}$ to $C_{32}$ or $C_{24}$ to $C_{28}$) alkylphenol may be present in the composition at less than 100 ppm, less than 50 ppm, or less than 25 ppm, less than 10 ppm, 1 to 7 ppm, or 5 to 7 ppm. The terpolymer may be present in the composition at 25 to 500 ppm, or 50 to 500 ppm, or 150 to 450 ppm or 250 to 450 ppm, or 250 to 400 ppm. In some embodiments the alkylene-coupled alkylphenol may be an alkylene-coupled $C_{24}$ to $C_{28}$ alkylphenol. In other embodiments, the alkylene-coupled $C_{24}$ to $C_{28}$ alkylphenol may be an aldehyde-coupled phenolic resin.

The terpolymer may be a terpolymer of two $C_2$ to $C_{40}$-$\alpha$-olefins and a $C_1$ to $C_{20}$-alkyl ester of an ethylenically unsaturated monocarboxylic acid having 3 to 15 carbon atoms. In other embodiments, the terpolymer may be formed from ethylene, propylene, and vinyl acetate.

The hydrocarbyl-substituted amine detergent having at least one tertiary amino group may be present at 5 to 90 ppm, or 10 to 70 ppm, or 10 to 60 ppm, or 20 to 60 ppm. In some embodiments, the hydrocarbyl-substituted amine detergent may be the reaction product of a hydrocarbyl-substituted acylating agent and a nitrogen-containing compound having a nitrogen atom capable of reacting with the hydrocarbyl-substituted acylating agent. The hydrocarbyl-substituted acylating agent may be a hydrocarbyl-substituted succinic anhydride or hydrocarbyl-substituted succinic acid. The hydrocarbyl-substituent may be decenylene, hexadecenylene, butylene, isobutylene, polyisobutylene, or combinations thereof. In some embodiments, the detergent's hydrocarbyl-substituent may be a polyisobutylene having a number average molecular weight ranging from 100 to 2300, or 100 to 1000, or 250 to 750, or 550. In other embodiments, the hydrocarbyl-substituted amine detergent may be quaternized. Suitable quaternizing agents include, but are not limited to, dialkyl sulfate, alkyl halide, hydrocarbyl substituted carbonate, hydrocarbyl epoxide, carboxylate, alkyl ester, or combinations thereof.

In some embodiments, the composition may further comprise other additives to improve one or more properties of the fuel. Suitable other additives include, but are not limited to, additional detergents/dispersants to the ones disclosed above, demulsifiers, foam inhibitors, lubricity agents, additional cold flow improvers to the ones disclosed above, antioxidants, corrosion inhibitors, cetane improvers, metal deactivators, solvents, or mixtures thereof.

In one embodiment, at least one fuel additive may comprise a detergent/dispersant that is an amphiphilic substance which possess at least one hydrophobic hydrocarbon radical with a number average molecular weight of 100 to 10000 and at least one polar moiety selected from (i) Mono- or polyamino groups having up to 6 nitrogen atoms, at least one nitrogen atom having basic properties; (ii) Hydroxyl groups in combination with mono or polyamino groups, at least one nitrogen atom having basic properties; (v) Polyoxy-$C_2$ to $C_4$ alkylene moieties terminated by hydroxyl groups, mono- or polyamino groups, at least one nitrogen atom having basic properties, or by carbamate groups; (vii) Moieties derived from succinic anhydride and having hydroxyl and/or amino and/or amido and/or imido groups; and/or (viii) Moieties obtained by Mannich reaction of substituted phenols with aldehydes and mono- or polyamines. In some embodiments, at least one fuel additive may comprise a detergent/dispersant such as ethoxylated alkyl amine.

The total normal paraffin wax content of the fuel may be at least 5 to 30 wt %, based on a total weight of the fuel and wherein the wax distribution is between $C_5$ to $C_{44}$, or $C_5$ to $C_{33}$, or $C_5$ to $C_{28}$ or $C_{11}$ to $C_{28}$, as measured by gas chromatography (ASTM D2887). In some embodiments the fuel has a cloud point temperature ("CP") ranging from −17 to 14° C. as measured using ASTM test method D5773. In some embodiments, the cold filter plugging point ("CFFP") of the composition is at least 5° C., 10° C., 20° C., or 30° C. lower than the CFPP of the fuel as measuring using ASTM D6371.

Methods of improving the wax anti-settling performance of a fuel are also disclosed. The methods may comprise adding the to a fuel an additive composition comprising at least three components as described above, namely, an alkylene-coupled $C_{10}$ to $C_{60}$ alkylphenol, a terpolymer, and a hydrocarbyl-substituted amine detergent having at least one tertiary amino group. The fuel may be a diesel fuel, a biodiesel fuel, or combinations thereof and have a total normal paraffin wax content of the fuel of at least 5 to 30 wt %, based on a total weight of the fuel and wherein the wax distribution is between $C_5$ to $C_{44}$, or $C_5$ to $C_{33}$, or $C_5$ to $C_{28}$ or $C_{11}$ to $C_{28}$, as measured by gas chromatography (ASTM D2887). The method may result in lowering the CFPP of the additized fuel by at least 5° C., 10° C., 20° C., or 30° C. compared to the unadditized fuel.

Uses of a fuel additive composition to improve the wax anti-settling performance of a fuel are also disclosed. The additive composition may comprise at least the three components as described above, namely, an alkylene-coupled $C_{10}$ to $C_{60}$ alkylphenol, a terpolymer, and a hydrocarbyl-substituted amine detergent having at least one tertiary amino group.

DETAILED DESCRIPTION OF THE INVENTION

Figure 1:
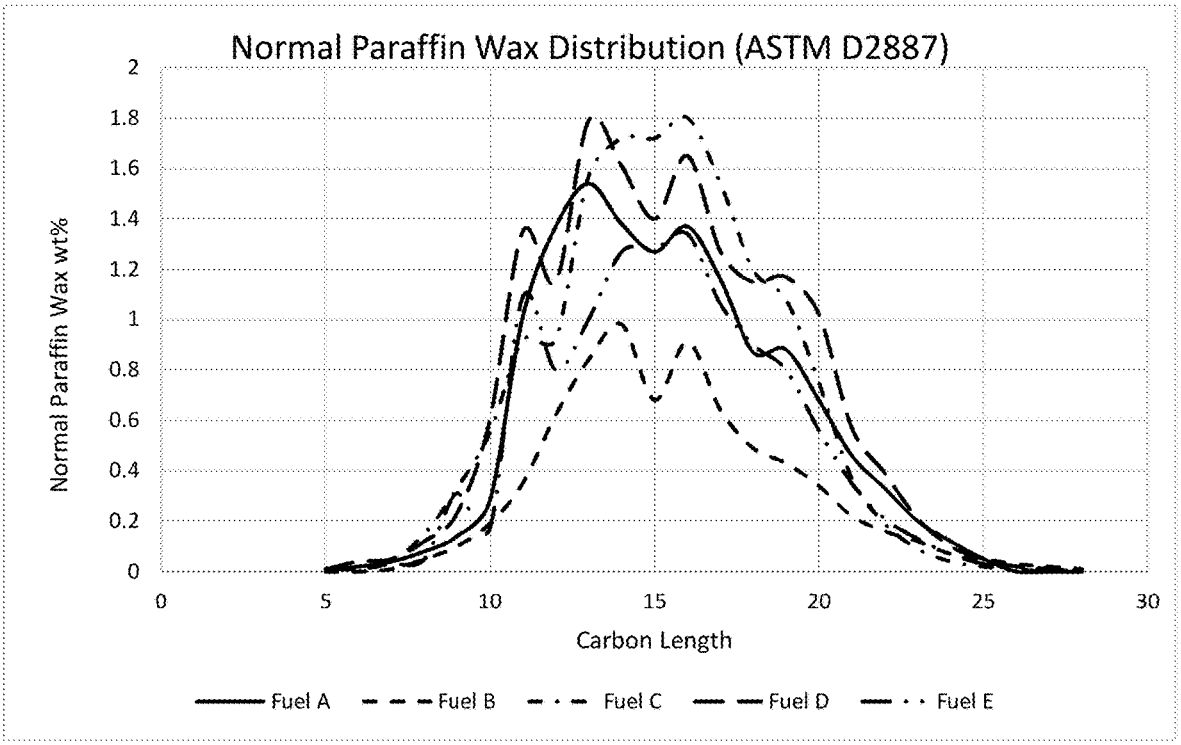
FIG. 1 shows the distribution of five different fuel samples (Samples, A, B, C, D, and E.)

Various preferred features and embodiments will be described below by way of non-limiting illustration. Compositions that comprise a fuel and a mixture of at least 3 different components, an alkylene-coupled $C_{10}$ to $C_{60}$ alkylphenol, a terpolymer, and a hydrocarbyl-substituted amine detergent having at least one tertiary amino group are disclosed. The fuel may be a diesel fuel, a biodiesel fuel, or combinations thereof.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In some embodiments the alkylene-coupled alkylphenol may be a $C_{10}$ to $C_{60}$, or $C_{10}$ to $C_{40}$, $C_{14}$ to $C_{32}$ or $C_{24}$ to $C_{28}$ alkylphenol. In other embodiments, the alkylene-coupled alkylphenol may be an alkylene-coupled $C_{24}$ to $C_{28}$ alkylphenol. In other embodiments, the alkylene-coupled $C_{24}$ to $C_{28}$ alkylphenol may be an aldehyde-coupled phenolic resin, for example a formaldehyde-coupled $C_{24}$ to $C_{28}$ alkylphenol.

In some embodiments, the alkylene-coupled alkylphenol may be present in the composition at less than 100 ppm, less than 50 ppm, less than 25 ppm, less than 10 ppm, 1 to 7 ppm, or 5 to 7 ppm. As used herein, ppm is parts per million by weight without diluent oils or solvents, or on an actives basis.

The terpolymer may be a terpolymer of two $C_2$ to $C_{40}$-α-olefins and a $C_1$ to $C_{20}$-alkyl ester of an ethylenically unsaturated monocarboxylic acid having 3 to 15 carbon atoms. In other embodiments, the terpolymer may be formed from ethylene, propylene, and vinyl acetate. The terpolymer may be present in the composition at 25 to 500 ppm, or 50 to 500 ppm, 150 to 450 ppm, 250 to 450 ppm, or 250 to 400 ppm.

In some embodiments, the hydrocarbyl-substituted amine detergent be a detergent/dispersant that is an amphiphilic substance which possess at least one hydrophobic hydrocarbon radical with a number average ($M_n$) molecular weight of 100 to 10,000 and at least one polar moiety selected from (i) Mono- or polyamino groups having up to 6 nitrogen atoms, at least one nitrogen atom having basic properties; (ii) Hydroxyl groups in combination with mono or polyamino groups, at least one nitrogen atom having basic properties; (v) Polyoxy-$C_2$ to $C_4$ alkylene moieties terminated by hydroxyl groups, mono- or polyamino groups, at least one nitrogen atom having basic properties, or by carbamate groups; (vii) Moieties derived from succinic anhydride and having hydroxyl and/or amino and/or amido and/or imido groups; and/or (viii) Moieties obtained by Mannich reaction of substituted phenols with aldehydes and mono- or polyamines.

The hydrophobic hydrocarbon radical in the above detergent/dispersant additives which ensures the adequate solubility in the fuel, has a number average molecular weight (Me) of 85 to 20,000, or 100 to 10,000, or 300 to 5000. In yet another embodiment, the detergent/dispersant additives have a $M_n$ of 300 to 3000, of 500 to 2500, of 700 to 2500, or 800 to 1500. Typical hydrophobic hydrocarbon radicals, may be polypropenyl, polybutenyl and polyisobutenyl radicals, with a number average molecular weight $M_n$, of 300 to 5000, of 300 to 3000, of 500 to 2500, or 700 to 2500. In one embodiment the detergent/dispersant additives have a $M_n$ of 800 to 1500.

As used herein, the number average molecular weight (Me) is measured using gel permeation chromatography ("GPC") (Waters Alliance e2695) based on polystyrene standards. The instrument is equipped with a refractive index detector and Waters Empower™ data acquisition and analysis software. The columns are polystyrene/divinylbenzene (PLgel, (3 "Mixed-C" and one 100 Angstrom, 5-micron particle size), available from Agilent Technologies). For the mobile phase, individual samples are dissolved in tetrahydrofuran and filtered with PTFE filters before they are injected into the GPC port.

Waters Alliance e2695 Operating Conditions:
Column Temperature: 40° C.
Autosampler Control: Run time: 45 minutes
Injection volume: 300 microliters
Flow rate: 1.0 ml/minute
Differential Refractometer (RI) (2414): Sensitivity: 16; Scale factor: 20

Persons ordinarily skilled in the art will understand that the weight average molecular weight ("$M_w$") may be measured using a similar technique to the one described above.

Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515.

A useful nitrogen containing dispersant includes the product of a Mannich reaction between (a) an aldehyde, (b) a polyamine, and (c) an optionally substituted phenol. The phenol may be substituted such that the Mannich product has a molecular weight of less than 7500. Optionally, the molecular weight may be less than 2000, less than 1500, less than 1300, or for example, less than 1200, less than 1100, less than 1000. In some embodiments, the Mannich product has a molecular weight of less than 900, less than 850, or less than 800, less than 500, or less than 400. The substituted phenol may be substituted with up to 4 groups on the aromatic ring. For example it may be a tri or di-substituted phenol. In some embodiments, the phenol may be a mono-substituted phenol. The substitution may be at the ortho, and/or meta, and/or para position(s). To form the Mannich product, the molar ratio of the aldehyde to amine is from 4:1 to 1:1 or, from 2:1 to 1:1. The molar ratio of the aldehyde to phenol may be at least 0.75:1; preferably from 0.75 to 1 to 4:1, preferably 1:1 to 4.1 more preferably from 1:1 to 2:1. To form the preferred Mannich product, the molar ratio of the phenol to amine is preferably at least 1.5:1, more preferably at least 1.6:1, more preferably at least 1.7:1, for example at least 1.8:1, preferably at least 1.9:1. The molar ratio of phenol to amine may be up to 5:1; for example it may be up to 4:1, or up to 3.5:1. Suitably it is up to 3.25:1, up to 3:1, up to 2.5:1, up to 2.3:1 or up to 2.1:1.

Other dispersants include polymeric dispersant additives, which are generally hydrocarbon-based polymers which contain polar functionality to impart dispersancy characteristics to the polymer. An amine is typically employed in preparing the high TBN nitrogen-containing dispersant. One or more poly(alkyleneamine)s may be used, and these may comprise one or more poly(ethyleneamine)s having 3 to 5 ethylene units and 4 to 6 nitrogen units. Such materials include triethylenetetramine (TETA), tetraethylenepentamine (TEPA), and pentaethylenehexamine (PEHA). Such materials are typically commercially available as mixtures of various isomers containing a range number of ethylene units and nitrogen atoms, as well as a variety of isomeric structures, including various cyclic structures. The poly (alkyleneamine) may likewise comprise relatively higher molecular weight amines known in the industry as ethylene amine still bottoms.

In some embodiments, the detergent may comprise a high TBN nitrogen containing detergent/dispersant, such as a succinimide, that is the condensation product of a hydrocarbyl-substituted succinic anhydride with a poly(alkyleneamine). Succinimide detergents/dispersants are more fully described in U.S. Pat. Nos. 4,234,435 and 3,172,892. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Nitrogen-containing detergents may be the reaction products of a carboxylic acid-derived acylating agent and an amine. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines typically having aliphatic substituents of up to 30 carbon atoms, and up to 11 nitrogen atoms. Acylated amino compounds suitable for use in the present invention may be those formed by the reaction of an acylating agent having a hydrocarbyl substituent of at least 8 carbon atoms and a compound comprising at least one primary or secondary amine group. The acylating agent may be a mono- or polycarboxylic acid (or reactive equivalent thereof) for example a substituted succinic, phthalic or propionic acid and the amino compound may be a polyamine or a mixture of polyamines, for example a mixture of ethylene polyamines. Alternatively the amine may be a hydroxyalkyl-substituted polyamine. The hydrocarbyl substituent in such acylating agents may comprise at least 10 carbon atoms. In one embodiment, the hydrocarbyl substituent may comprise at least 12, for example 30 or 50 carbon atoms. In yet another embodiment, it may comprise up to 200 carbon atoms. The hydrocarbyl substituent of the acylating agent may have a number average molecular weight ($M_n$) of 170 to 2800, for example from 250 to 1500. In other embodiments, the substituent's $M_n$ may range from 500 to 1500, or alternatively from 500 to 1100. In yet another embodiment, the substituent's $M_n$ may range from 700 to 1300. In another embodiment, the hydrocarbyl substituent may have a number average molecular weight of 700 to 1000, or 700 to 850, or, for example, 750.

Accordingly, in some embodiments, the hydrocarbyl-substituted amine detergent may be the reaction product of a hydrocarbyl-substituted acylating agent and a nitrogen-containing compound having a nitrogen atom capable of reacting with the hydrocarbyl-substituted acylating agent. The hydrocarbyl-substituted acylating agent may be a hydrocarbyl-substituted succinic anhydride or hydrocarbyl-substituted succinic acid. The hydrocarbyl-substituent may be decenylene, hexadecenylene, butylene, isobutylene, polyisobutylene, or combinations thereof. The detergent's hydrocarbyl-substituent may be a polyisobutylene ("PIB") having a number average molecular weight ranging from 100 to 2300, or 100 to 1000, or 250 to 750, or 550.

In other embodiments, the hydrocarbyl-substituted amine detergent may be quaternized to form a quaternary ammonium salt. The quaternary ammonium salts can comprise (a) a compound comprising (i) at least one tertiary amino group as described above, and (ii) a hydrocarbyl-substituent having a number average molecular weight of 100 to 5000, or 250 to 4000, or 100 to 4000 or 100 to 2500 or 3000; and (b) a quaternizing agent suitable for converting the tertiary amino group of (a)(i) to a quaternary nitrogen, as described above. The other quaternary ammonium salts are more thoroughly described in U.S. Pat. No. 7,951,211, issued May 31, 2011, and U.S. Pat. No. 8,083,814, issued Dec. 27, 2011, and U.S. Publication Nos. 2013/0118062, published May 16, 2013, 2012/0010112, published Jan. 12, 2012, 2013/0133243, published May 30, 2013, 2008/0113890, published May 15, 2008, and 2011/0219674, published Sep. 15, 2011, US 2012/0149617 published May 14, 2012, US 2013/0225463 published Aug. 29, 2013, US 2011/0258917 published Oct. 27, 2011, US 2011/0315107 published Dec. 29, 2011, US 2013/0074794 published Mar. 28, 2013, US 2012/0255512 published Oct. 11, 2012, US 2013/0333649 published Dec. 19, 2013, US 2013/0118062 published May 16, 2013, and international publications WO Publication Nos. 2011/141731, published Nov. 17, 2011, 2011/095819, published Aug. 11, 2011, and 2013/017886, published Feb. 7, 2013, WO 2013/070503 published May 16, 2013, WO 2011/110860 published Sep. 15, 2011, WO 2013/017889 published Feb. 7, 2013, WO 2013/017884 published Feb. 7, 2013.

The quaternary ammoniums salts can be prepared from hydrocarbyl substituted acylating agents, such as, for example, polyisobutyl succinic acids or anhydrides, having a hydrocarbyl substituent with a number average molecular weight of greater than 1200 polyisobutyl succinic acids or anhydrides, having a hydrocarbyl substituent with a number average molecular weight of 300 to 750, or polyisobutyl succinic acids or anhydrides, having a hydrocarbyl substituent with a number average molecular weight of 1000 $M_n$.

In an embodiment, the salts may be an imide prepared from the reaction of a nitrogen containing compound and a hydrocarbyl substituted acylating agent having a hydrocarbyl substituent with a number average molecular weight of 1300 to 3000. In an embodiment, the quaternary ammonium salts prepared from the reaction of nitrogen containing compound and a hydrocarbyl substituted acylating agent having a hydrocarbyl substituent with a number average molecular weight of greater than 1200 $M_n$ or, having a hydrocarbyl substituent with a number average molecular weight of 300 to 750 is an amide or ester.

In an embodiment the nitrogen containing compound of the quaternary ammonium salts is an imidazole or nitrogen containing compound of either of formulas:

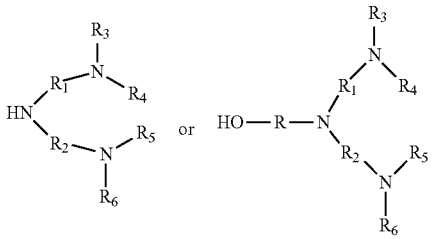

wherein R may be a $C_1$ to $C_6$ alkylene group; each of $R_1$ and $R_2$, individually, may be a $C_1$ to $C_6$ hydrocarbylene group; and each of $R_3$, $R_4$, $R_5$, and $R_6$, individually, may be a hydrogen or a $C_1$ to $C_6$ hydrocarbyl group.

In other embodiments, the quaternizing agent used to prepare the quaternary ammonium salts include, but are not limited to, a dialkyl sulfate, an alkyl halide, a hydrocarbyl substituted carbonate, a hydrocarbyl epoxide, a carboxylate, alkyl esters, or mixtures thereof. In some cases, the quaternizing agent can be a hydrocarbyl epoxide. In some cases, the quaternizing agent can be a hydrocarbyl epoxide in combination with an acid. In some cases, the quaternizing agent can be a salicylate, oxalate or terephthalate. In an embodiment the hydrocarbyl epoxide is an alcohol-functionalized epoxide or $C_4$ to $C_{14}$ epoxides. In some embodiments, the quaternizing agent is multi-functional resulting in the additional quaternary ammonium salts being a coupled quaternary ammoniums salts.

The hydrocarbyl-substituted amine detergent having at least one tertiary amino group may be present in the composition at 5 to 90 ppm, or 10 to 70 ppm, or 10 to 60 ppm, or 20 to 60 ppm.

In some embodiments, the composition may comprise a fuel, a PIB-succinimide detergent and/or a quaternized PIB-succinimide detergent, a $CH_2$-coupled $C_{24}$-$C_{28}$ phenol, and a vinyl acetate terpolymer. The PIB-succinimide detergent and/or quaternized PIB-succinimide detergent may be present at 30 to 90 ppm, the $CH_2$-coupled $C_{24}$-$C_{28}$ phenol may be present at less than 25 ppm, less than 10 ppm, or 1 to 7 ppm, and the vinyl acetate terpolymer may be present at 150 to 450 ppm.

Additional Additives

In some embodiments, the composition may further comprise other additives to improve one or more properties of the fuel. Suitable other additives include, but are not limited to, additional detergents/dispersants to the ones disclosed above, demulsifiers, foam inhibitors, lubricity agents, additional cold flow improvers to the ones disclosed above, antioxidants, corrosion inhibitors, cetane improvers, metal deactivators, solvents, or mixtures thereof.

In a yet another embodiment, a fuel composition further comprises a cold flow improver in addition to the terpolymer described above. The cold flow improver is typically selected from (1) copolymers of a $C_2$- to $C_{40}$-olefin with at least one further ethylenically unsaturated monomer; (2) comb polymers; (3) polyoxyalkylenes; (4) polar nitrogen compounds; and (5) poly(meth)acrylic esters made from linear alcohols having 10 to 22 carbon atoms. It is possible to use either mixtures of different representatives from one of the particular classes (1) to (5) or mixtures of representatives from different classes (1) to (5).

Suitable $C_2$- to $C_{40}$-olefin monomers for the copolymers of class (1) are, for example, those having 2 to 20 and especially 2 to 10 carbon atoms, and 1 to 3 and preferably 1 or 2 carbon-carbon double bonds, especially having one carbon-carbon double bond. In the latter case, the carbon-carbon double bond may be arranged either terminally (α-olefins) or internally. However, preference is given to α-olefins, more preferably α-olefins having 2 to 6 carbon atoms, for example propene, 1-butene, 1-pentene, 1-hexene and in particular ethylene. The at least one further ethylenically unsaturated monomer of class (1) is preferably selected from alkenyl carboxylates; for example, $C_2$- to $C_{14}$-alkenyl esters, for example the vinyl and propenyl esters, of carboxylic acids having 2 to 21 carbon atoms, whose hydrocarbon radical may be linear or branched among these, preference is given to the vinyl esters, examples of suitable alkenyl carboxylates are vinyl acetate, vinyl propionate, vinyl butyrate, vinyl 2-ethylhexanoate, vinyl neopentanoate, vinyl hexanoate, vinyl neononanoate, vinyl neodecanoate and the corresponding propenyl esters, (meth)acrylic esters; for example, esters of (meth)acrylic acid with $C_1$- to $C_2$O-alkanols, especially $C_1$- to $C_{10}$-alkanols, in particular with methanol, ethanol, propanol, isopropanol, n-butanol, sec-butanol, isobutanol, tert-butanol, pentanol, hexanol, heptanol, octanol, 2-ethylhexanol, nonanol and decanol, and structural isomers thereof and further olefins; preferably higher in molecular weight than the abovementioned $C_2$- to $C_{40}$-olefin base monomer for example, the olefin base monomer used is ethylene or propene, suitable further olefins are in particular $C_{10}$- to $C_{40}$-α-olefins.

Suitable copolymers of class (1) are also those which comprise two or more different alkenyl carboxylates in copolymerized form, which differ in the alkenyl function and/or in the carboxylic acid group. Likewise suitable are copolymers which, as well as the alkenyl carboxylate(s), comprise at least one olefin and/or at least one (meth)acrylic ester in copolymerized form.

The at least one or the further ethylenically unsaturated monomer(s) are copolymerized in the copolymers of class (1) in an amount of preferably 1 to 50% by weight, especially 10 to 45% by weight and in particular 20 to 40% by weight, based on the overall copolymer. The main proportion in terms of weight of the monomer units in the copolymers of class (1) therefore originates generally from the $C_2$ to $C_{40}$ base olefins. The copolymers of class (1) may have a number average molecular weight $M_n$ of 1000 to 20,000, or 1000 to 10,000 or 1000 to 8000.

Typical comb polymers of component (2) are, for example, obtainable by the copolymerization of maleic anhydride or fumaric acid with another ethylenically unsaturated monomer, for example with an a-olefin or an unsaturated ester, such as vinyl acetate, and subsequent esterification of the anhydride or acid function with an alcohol having at least 10 carbon atoms. Further suitable comb polymers are copolymers of α-olefins and esterified comonomers, for example esterified copolymers of styrene and maleic anhydride or esterified copolymers of styrene and fumaric acid. Suitable comb polymers may also be polyfumarates or polymaleates. Homo- and copolymers of vinyl ethers are also suitable comb polymers. Comb polymers suitable as components of class (2) are, for example, also those described in WO 2004/035715 and in "Comb-Like Polymers. Structure and Properties", N. A. Plate and V. P. Shibaev, J. Poly. Sci. Macromolecular Revs. 8, pages 117 to 253 (1974). Mixtures of comb polymers are also suitable.

Polyoxyalkylenes suitable as components of class (3) are, for example, polyoxyalkylene esters, polyoxyalkylene ethers, mixed polyoxyalkylene ester/ethers and mixtures thereof. These polyoxyalkylene compounds preferably comprise at least one linear alkyl group, preferably at least two linear alkyl groups, each having 10 to 30 carbon atoms and a polyoxyalkylene group having a number average molecular weight of up to 5000. Such polyoxyalkylene compounds are described, for example, in EP-A 061 895 and also in U.S. Pat. No. 4,491,455. Particular polyoxyalkylene compounds are based on polyethylene glycols and polypropylene glycols having a number average molecular weight of 100 to 5000. Additionally suitable are polyoxyalkylene mono- and diesters of fatty acids having 10 to 30 carbon atoms, such as stearic acid or behenic acid.

Polar nitrogen compounds suitable as components of class (4) may be either ionic or nonionic and may have at least one substituent, or at least two substituents, in the form of a tertiary nitrogen atom of the general formula $>NR^7$ in which $R^7$ is a $C_8$- to $C_{40}$-hydrocarbon radical. The nitrogen substituents may also be quaternized i.e. be in cationic form. An example of such nitrogen compounds is that of ammonium salts and/or amides which are obtainable by the reaction of at least one amine substituted by at least one hydrocarbon radical with a carboxylic acid having 1 to 4 carboxyl groups or with a suitable derivative thereof. The amines may comprise at least one linear $C_8$- to $C_{40}$-alkyl radical. Primary amines suitable for preparing the polar nitrogen compounds mentioned are, for example, octylamine, nonylamine, decylamine, undecylamine, dodecylamine, tetradecylamine and the higher linear homologs. Secondary amines suitable for this purpose are, for example, dioctadecylamine and methylbehenylamine. Also suitable for this purpose are amine mixtures, in particular amine mixtures obtainable on the industrial scale, such as fatty amines or hydrogenated tallow amines, as described, for example, in Ullmann's Encyclopedia of Industrial Chemistry, 6th Edition, "Amines, aliphatic" chapter. Acids suitable for the reaction are, for example, cyclohexane-1,2-dicarboxylic acid, cyclohexene-1,2-dicarboxylic acid, cyclopentane-1,2-dicarboxylic acid, naphthalene dicarboxylic acid, phthalic acid, isophthalic acid, terephthalic acid, and succinic acids substituted by long-chain hydrocarbon radicals.

Poly(meth)acrylic esters suitable as cold flow improvers of class (5) are either homo- or copolymers of acrylic and methacrylic esters. Preference is given to copolymers of at least two different (meth)acrylic esters which differ with regard to the esterified alcohol. The copolymer optionally comprises another different olefinically unsaturated monomer in copolymerized form. The weight-average molecular weight of the polymer is preferably 50,000 to 500,000. The polymer may be a copolymer of methacrylic acid and methacrylic esters of saturated $C_{14}$ and $C_{15}$ alcohols, the acid groups having been neutralized with hydrogenated tallow amine. Suitable poly(meth)acrylic esters are described, for example, in WO 00/44857.

In yet other embodiments, the composition may comprise additional terpolymers prepared from a $C_2$- to $C_{40}$-α-olefin, a to $C_{20}$-alkyl ester of an ethylenically unsaturated monocarboxylic acid having 3 to 15 carbon atoms and a $C_2$- to $C_{14}$-alkenyl ester of a saturated monocarboxylic acid having 2 to 21 carbon atoms. Terpolymers of this kind are described in WO 2005/054314. A typical terpolymer of this kind is formed from ethylene, an alkyl acrylate (for example 2-ethylhexyl acrylate) and vinyl acetate.

The cold flow improver or the mixture of different cold flow improvers is added to the middle distillate fuel or diesel fuel in a total amount of preferably 0 to 5000 ppm by weight, or 10 to 5000 ppm by weight, or 20 to 2000 ppm by weight, or 50 to 1000 ppm by weight, or 100 to 700 ppm by weight, for example of 200 to 500 ppm by weight. In one embodiment, the cold flow improver (or cold flow improver mixture) may be present from 10 to 200 ppm by weight.

The disclosed technology may also be used with demulsifiers comprising a hydrocarbyl-substituted dicarboxylic acid in the form of the free acid, or in the form of the anhydride which may be an intramolecular anhydride, such as succinic, glutaric, or phthalic anhydride, or an intermolecular anhydride linking two dicarboxylic acid molecules together. The hydrocarbyl substituent may have from 12 to 2000 carbon atoms and may include polyisobutenyl substituents having a number average molecular weight of 300 to 2800. Exemplary hydrocarbyl-substituted dicarboxylic acids include, but are not limited to, hydrocarbyl-substituted acids derived from malonic, succinic, glutaric, adipic, pimelic, suberic, azelaic, sebacic, undecanedioic, dodecanedioic, phthalic, isophthalic, terphthalic, ortho, meta, or paraphenylene diacetic, maleic, fumaric, or glutaconic acids.

In some embodiments, the fuel additive composition may comprise antifoams or foam inhibitors, the foam inhibitors may be poly(acrylate) and/or poly(acrylamide) copolymers prepared by polymerizing a (meth)acrylate or (meth)acrylamide monomer comprising $C_1$ to $C_{30}$ alkyl esters of (meth) acrylic acid or mono- or di-$C_1$ to $C_{27}$ alkyl-substituted (meth)acrylamide. In some embodiments the foam inhibitors may be prepared by polymerizing (i) a (meth)acrylate monomer comprising $C_1$ to $C_4$ alkyl esters of (meth)acrylic acid; (ii) a (meth)acrylate monomer comprising $C_5$ to $C_{12}$ alkyl esters of (meth)acrylic acid; and (iii) optionally at least one additional monomer comprising a solubility monomer, a surface tension monomer, a monomer comprising $C_1$ to $C_{30}$ alkyl esters of (meth)acrylic acid, or combinations thereof.

Additional antifoams and/or foam inhibitors include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers. The disclosed technology may also be used with a silicone-containing antifoam agent in combination with a $C_5$-$C_{17}$ alcohol. In yet other embodiments, the additional antifoams may include organic silicones such as polydimethyl siloxane, polyethylsiloxane, polydiethylsiloxane, polyacrylates and polymethacrylates, trimethyl-trifluoro-propylmethyl siloxane and the like.

The compositions disclosed herein may also comprise lubricity improvers or friction modifiers typically based on fatty acids or fatty acid esters. Typical examples are tall oil fatty acid, as described, for example, in WO 98/004656, and glyceryl monooleate. The reaction products, described in U.S. Pat. No. 6,743,266 B2, of natural or synthetic oils, for example triglycerides, and alkanolamines are also suitable as such lubricity improvers. Additional examples include commercial tall oil fatty acids containing polycyclic hydrocarbons and/or rosin acids.

The compositions disclosed herein may also comprise metal deactivators to reduce the amount of metal solubilized in the fuel (reduces "metal pick-up"). These additives may be a hydrocarbon substituted with at least two carboxy functionalities in the form of acids or at least one carboxy functionality in the form an anhydride. Suitable metal pick-up additives include di-acid polymers derived from fatty acids and/or polyolefins, including polyalkenes. Exemplary polyolefins include $C_{10}$ to $C_{20}$ polyolefins, $C_{12}$ to $C_{18}$ polyolefins, and/or $C_{16}$ to $C_{18}$ polyolefins. The polyalkene may be characterized by a $M_n$ (number average molecular weight) of at least about 300. In some embodiments, the metal-pick-up additive comprises more hydrocarbyl substituted succinic anhydride groups. In some embodiments the hydrocarbyl substituted acylating agent comprises one or more hydrolyzed hydrocarbyl substituted succinic anhydride groups (i.e., hydrocarbyl substituted succinic acid). In some embodiments the hydrocarbyl substituents are derived from homopolymers and/or copolymers containing 2 to 10 carbon atoms. In some embodiments the hydrocarbyl substituents above are derived from polyisobutylene. In one embodiment, the metal pick-up additive comprises hydrolyzed polyisobutylene succinic anhydride (PIMA) or polyisobutylene succinic acid.

In some embodiments, the compositions disclosed herein may comprise one or more corrosion inhibitors. Suitable corrosion inhibitors include those described in paragraphs 5 to 8 of US application U.S. Ser. No. 05/038,319, published as WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

In some embodiments, the compositions disclosed herein may comprise one or more antioxidants. Suitable antioxidants include arylamines, diarylamines, alkylated arylamines, alkylated diaryl amines, phenols, hindered phenols, sulfurized olefins, or mixtures thereof. In one embodiment the lubricating composition includes an antioxidant, or mixtures thereof. In some embodiments, the fuel composition may comprise at least one combustion improver. Combustion improvers include for example octane and cetane improvers. Suitable cetane number improvers are, for example, aliphatic nitrates such as 2-ethylhexyl nitrate and cyclohexyl nitrate and peroxides such as di-tert-butyl peroxide.

In some embodiments, the composition may comprise an ethoxylated alkyl amine. The ethoxylated alkyl amine may include amines represented by the formula

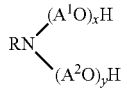

where R is a hydrocarbyl group having about 4 to 30 carbon atoms, $A^1$ and $A^2$ are vicinal alkylene groups, and the sum of x and y is an integer and is at least 1. The hydrocarbyl group is a univalent radical of carbon atoms that is predominantly hydrocarbon in nature but can have nonhydrocarbon substituent groups and can have heteroatoms. The hydrocarbyl group R can be an alkyl or alkylene group of about 4 to 30 carbon atoms, preferably about 10 to 22 carbon atoms. The vicinal alkylene groups $A^1$ and $A^2$ can be the same or different and include ethylene, propylene and butylene having the carbon to nitrogen and carbon to oxygen bonds on adjacent or neighboring carbon atoms. Examples of alkoxylated fatty amines include diethoxylated tallowamine, diethoxylated oleylamine, diethoxylated stearylamine, and the diethoxylated amine from soybean oil fatty acids. Alkoxylated fatty amines are commercially available from Akzo under the Ethomeen® series.

The total normal paraffin wax content of the fuel may be at least 5 to 30 wt %, based on a total weight of the fuel and wherein the wax distribution is between $C_5$ to $C_{44}$, or $C_5$ to $C_{33}$, or $C_5$ to $C_{28}$, or $C_{11}$ to $C_{28}$, as measured by gas chromatography (ASTM D2887). In another embodiment, the total normal parafic wax content of the fuel may be at least 5 to 30 wt %, based on a total weight of the fuel and wherein the wax distribution is between $C_{11}$ to $C_{28}$. In another embodiment, the total normal parafic wax content of the fuel may be at least 7 to 30 wt %, based on a total weight of the fuel and wherein the wax distribution is between $C_{11}$ to $C_{28}$. In some embodiments the fuel has a cloud point temperature ("CP") ranging from −17 to 14° C. as measured using ASTM test method D5773. In some embodiments, the cold filter plugging point ("CFFP") of the composition is at least 5° C., 10° C., 20° C., or 30° C. lower than the CFPP of the fuel as measuring using ASTM D6371.

Methods of improving the wax anti-settling performance of a fuel are also disclosed. The methods may comprise adding the to a fuel an additive composition comprising at least three components as described above, namely, an alkylene-coupled $C_{10}$ to $C_{60}$ alkylphenol, a terpolymer, and a hydrocarbyl-substituted amine detergent having at least one tertiary amino group. The fuel may be a diesel fuel, a biodiesel fuel, or combinations thereof and have a total normal paraffin wax content of the fuel of at least 5 to 30 wt %, based on a total weight of the fuel and wherein the wax distribution is between $C_5$ to $C_{44}$, or $C_5$ to $C_{33}$, or $C_5$ to $C_{28}$, or $C_{11}$ to $C_{28}$ as measured by gas chromatography (ASTM D2887). The method may result in lowering the CFPP of the additized fuel by at least 5° C., 10° C., 20° C., or 30° C. compared to the unadditized fuel.

Uses of a fuel additive composition to improve the wax anti-settling performance of a fuel are also disclosed. The additive composition may comprise at least three components as described above, namely, an alkylene-coupled $C_{10}$ to $C_{60}$ alkylphenol, a terpolymer, and a hydrocarbyl-substituted amine detergent having at least one tertiary amino group. In some embodiments, the fuel additive composition may comprise 0.2 to 3 wt % of an alkylene-coupled $C_{10}$ to $C_{60}$ alkylphenol; 10 to 50 wt % of a terpolymer; 2 to 10 wt % of a hydrocarbyl-substituted amine detergent having at least one tertiary group; and an optional solvent. The fuel may be a diesel fuel, a biodiesel fuel, or combinations thereof. In some embodiments, the fuel has a total normal paraffin wax content of at least 5 to 30 wt %, based on a total weight of the fuel and wherein the wax distribution is between $C_5$ to $C_{44}$, or $C_5$ to $C_{33}$, or $C_5$ to $C_{28}$, or $C_{11}$ to $C_{28}$ as measured by gas chromatography (ASTM D2887). In yet other embodiments, the fuel has a total normal paraffin wax content of at least 5 to 30 wt %, based on a total weight of the fuel and wherein the wax distribution is between $C_{11}$ to $C_{28}$. In some embodiments, the CFPP of the fuel with the additive composition is at least 5° C., 10° C., 20° C., or 30° C. lower than the CFPP of the fuel without the additive composition, as measured using ASTM D6371.

Additive Packages

The fuel additives disclosed herein may be provided with one or more additives, including the additional additives, described above in an additive package. The additive package may comprise one or more additives in a concentrated solution suitable for adding to a diesel fuel. The additive package may also comprise one or more solvents to improve the compatibility of one or more components or to improve clarity or facilitate handling and transfer of the additive package itself. Suitable solvents include, but are not limited to an aliphatic hydrocarbon, an aromatic hydrocarbon, an oxygen-containing composition, or a mixture thereof. The flash point of the solvent is generally about 25° C. or higher.

Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Accordingly, in some embodiments the hydrocarbon solvent is an aromatic naphtha having a flash point above 62° C. or an aromatic naphtha having a flash point of 40° C. or a kerosene with a 16% aromatic content having a flash point above 62° C.

The oxygen containing composition can include an alcohol, a ketone, an ester of a carboxylic acid, a glycol and/or a polyglycol, or a mixture thereof. The alcohols may contain at least 2 carbon atoms, or at least 4, or at least 6 or at least 8 carbon atoms. In some embodiments, the alcohols have 2 to 20 carbon atoms, 4 to 16 carbon atoms, 6 to 12 carbon atoms, 8 to 10 carbon atoms, or just 8 carbon atoms. These alcohols often have a 2-($C_{1-4}$ alkyl) substituent, namely, methyl, ethyl, or any isomer of propyl or butyl. Examples of suitable alcohols include 2-propylheptanol, 2-methyldecanol, 2-ethylpentanol, 2-ethylhexanol, 2-ethylnonanol, 2-propylheptanol, 2-butylheptanol, 2-butyloctanol, isooctanol, dodecanol, cyclohexanol, methanol, ethanol, propan-1-ol, 2-methylpropan-2-ol, 2-methylpropan-1-ol, butan-1-ol, butan-2-ol, pentanol and its isomers, and mixtures thereof. In one embodiment the alcohol may be 2-ethylhexanol, 2-ethyl nonanol, 2-methylheptanol, or combinations thereof. In one embodiment alcohol is 2-ethylhexanol.

In some embodiments, the solvent is substantially free of to free of sulphur, i.e., the solvent has a sulphur content in below 50 ppm, 25 ppm, 18 ppm, 10 ppm, 8 ppm, 4 ppm, or below 2 ppm. The solvent can be present in the additive package at 0 to 90 percent by weight, and in other instances at 3 to 80 percent by weight, or 10 to 70 percent by weight, or even 10 to 20 percent by weight.

Exemplary additive package compositions are included in Table 1. The amounts shown are in wt % on an actives basis, based on a total weight of the additive package.

TABLE 1

| | Additive Package |
|---|---|
| PIB-succinimide detergent or quat salt thereof | 2 to 10 |
| Aldehyde-coupled phenolic resin | 0.2 to 3 |
| Vinyl acetate terpolymer | 10 to 50 |
| Hydrolyzed PIBSA (metal pick-up) | 0 to 20 |
| Commercial demulsifier | 0 to 6 |
| Poly(acrylate) polymer antifoam component | 0 to 3 |
| Solvent | Balance |

Fuel and Fuel Compositions

The fuel additives described herein are suitable for use in a fuel which is liquid at room temperature and is useful in fueling an engine. The fuel is normally a liquid at ambient conditions e.g., room temperature (20 to 30° C.). The fuel additives are particularly useful in fuels suitable for fueling a diesel engine, including a hydrocarbon fuel, a nonhydrocarbon fuel, or a mixture thereof. The hydrocarbon fuel can be a diesel fuel as defined by EN590 or ASTM specification D975. The hydrocarbon fuel can be a hydrocarbon prepared by a gas to liquid process to include for example hydrocarbons prepared by a process such as the Fischer-Tropsch process.

The nonhydrocarbon fuel can be a biodiesel fuel comprised of mono-alkyl esters of long chain fatty acids derived from vegetable oils or animal fats as specified in ASTM D6751 or D7467. Nonhydrocarbon fuels include, transesterified oils and/or fats from plants and animals such as rapeseed methyl ester and soybean methyl ester. Mixtures of hydrocarbon and nonhydrocarbon fuels can include for example, diesel fuel and ethanol, and diesel fuel and a transesterified plant oil such as rapeseed methyl ester. In an embodiment of the invention the liquid fuel is an emulsion of water in a hydrocarbon fuel, a nonhydrocarbon fuel, or a mixture thereof. In some embodiments, the fuel may comprise a hydro-treated vegetable oil ("HVO"), commonly called a renewable diesel. In other embodiments, the fuel may comprise mixtures of diesel and HVO. In yet other embodiments the fuel can comprise blends of biodiesel and diesel, blends of HVO and diesel, or blends of HVO and biodiesel.

Accordingly, in some embodiments, the fuel may be a diesel as defined in ASTM D975 and/or biodiesel as defined in ASTM D6751 or D7467, including, but not limited to, a gas to liquid ("GTL") diesel, biomass to liquid ("BTL") fuel, or combinations thereof.

In several embodiments, the fuel can have a sulfur content on a weight basis that is 5000 ppm or less, 1000 ppm or less, 300 ppm or less, 200 ppm or less, 30 ppm or less, or 10 ppm or less. In another embodiment the fuel can have a sulfur content on a weight basis of 1 to 100 ppm.

The fuel is present in a fuel composition in a major amount that is generally greater than 50 percent by weight, and in other embodiments is present at greater than 90 percent by weight, greater than 95 percent by weight, greater than 99.5 percent by weight, or greater than 99.8 percent by weight.

In some embodiments, the fuel composition may comprise at least one combustion improver. Combustion improvers include for example octane and cetane improvers. Suitable cetane number improvers are, for example, aliphatic nitrates such as 2-ethylhexyl nitrate and cyclohexyl nitrate and peroxides such as di-tert-butyl peroxide.

Exemplary compositions including a fuel and additives are shown in Table 2 below.

TABLE 2

| | Application- Final Fuel Composition | | |
|---|---|---|---|
| Alkylene-coupled C10-C60 alkylphenol | 0.10-100 ppm | 0.5 to 25 ppm | 1 to 15 ppm |
| Terpolymer | 25-500 ppm | 150-450 ppm | 250-400 ppm |
| Hydrocarbyl substituted amine detergent having at least one tertiary amino group | 5-90 ppm | 10-90 ppm | 10-70 ppm |
| Cold Flow Improvers | 0-5000 ppm | 20-2000 ppm | 100-700 ppm |
| Lubricity Improvers | 0-500 ppm | 50-250 ppm | 10-50 ppm |
| Corrosion Inhibitors | 10-120 ppm | 20-100 ppm | 30-80 ppm |
| Demulsifiers | 0-60 ppm | 1-40 ppm | 4-30 ppm |
| Antifoams | 0-40 ppm | 0.5-20 ppm | 1-10 ppm |
| Cetane improvers | 0-5000 ppm | 250-2500 ppm | 500-2000 ppm |
| Metal Deactivators | 0-50 ppm | 0.5-50 ppm | 1-25 ppm |
| Antioxidants | 0-200 ppm | 1-150 ppm | 5-100 ppm |
| Fuel (with optional solvent) | Bulk | Bulk | Bulk |

According, in some embodiments, the composition may comprise 1 to 15 ppm of an alkylene-coupled $C_{10}$ to $C_{60}$ alkylphenol, 250 to 400 ppm of a terpolymer, and 10 to 70 ppm of a hydrocarbyl-substituted amine detergent having at least one tertiary amino group.

INDUSTRIAL APPLICATION

In one embodiment, the invention is useful in a liquid fuel in an internal combustion engine. The internal combustion engine may be a diesel engine. Exemplary internal combustion engines include, but are not limited to, compression ignition engines; 4-stroke cycles; liquid fuel supplied via direct injection, indirect injection, common rail and unit injector systems; light (e.g. passenger car) and heavy duty (e.g. commercial truck) engines; and engines fueled with hydrocarbon and non-hydrocarbon fuels and mixtures thereof. The engines may be part of integrated emissions systems incorporating such elements as; EGR systems; aftertreatment including three-way catalyst, oxidation catalyst, $NO_x$ absorbers and catalysts, catalyzed and non-catalyzed particulate traps optionally employing fuel-borne catalyst; variable valve timing; and injection timing and rate shaping.

In one embodiment, the technology may be used with diesel engines having direct fuel injection systems wherein the fuel is injected directly into the engine's combustion chamber. The ignition pressures may be greater than 1000 bar and, in one embodiment, the ignition pressure may be greater than 1350 bar. Accordingly, in another embodiment, the direct fuel injection system may be a high-pressure direct fuel injection system having ignition pressures greater than 1350 bar. Exemplary types of high-pressure direct fuel injection systems include, but are not limited to, unit direct injection (or "pump and nozzle") systems, and common rail systems. In unit direct injection systems the high-pressure fuel pump, fuel metering system and fuel injector are combined into one apparatus. Common rail systems have a series of injectors connected to the same pressure accumulator, or rail. The rail in turn, is connected to a high-pressure fuel pump. In yet another embodiment, the unit direct injection or common rail systems may further comprise an optional turbocharged or supercharged direct injection system.

The amount of each chemical component described is presented exclusive of any solvent or diluent oil, which may be customarily present in the commercial material, that is, on an active chemical basis, or "actives basis", unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The disclosed technology provides a novel fuel composition that may have improved wax-anti settling properties, which may be better understood with reference to the following examples.

Examples

For the examples, five different fuel samples (Samples A, B, C, D, and E) were obtained. The normal paraffinic wax distribution and total wax content of the fuel samples was measured by gas chromatography according to test method ASTM D2887. The distribution and total wax content of the different fuel samples are shown in Table 3 below and in FIG. 1.

TABLE 3

| | Fuel Sample (diesel) | | | | |
|---|---|---|---|---|---|
| | A | B | C | D | E |
| Carbon Length | Normal paraffin wt % wax distribution as measured using D2887 | | | | |
| 5 | 0.01 | 0 | 0.01 | 0.01 | 0.01 |
| 6 | 0.02 | 0 | 0.01 | 0.04 | 0.01 |
| 7 | 0.04 | 0.01 | 0.04 | 0.05 | 0.03 |
| 8 | 0.08 | 0.05 | 0.15 | 0.12 | 0.05 |
| 9 | 0.14 | 0.1 | 0.33 | 0.23 | 0.31 |
| 10 | 0.28 | 0.19 | 0.55 | 0.6 | 0.17 |
| 11 | 1.01 | 0.35 | 0.92 | 1.35 | 1.09 |
| 12 | 1.37 | 0.62 | 0.92 | 1.15 | 0.8 |
| 13 | 1.54 | 0.84 | 1.57 | 1.79 | 1 |
| 14 | 1.38 | 0.98 | 1.72 | 1.61 | 1.27 |
| 15 | 1.27 | 0.68 | 1.72 | 1.4 | 1.28 |
| 16 | 1.37 | 0.91 | 1.8 | 1.65 | 1.34 |
| 17 | 1.16 | 0.64 | 1.54 | 1.27 | 1.06 |
| 18 | 0.87 | 0.49 | 1.2 | 1.15 | 0.9 |
| 19 | 0.88 | 0.43 | 1.08 | 1.17 | 0.8 |
| 20 | 0.68 | 0.34 | 0.75 | 1.02 | 0.56 |
| 21 | 0.46 | 0.22 | 0.37 | 0.57 | 0.35 |
| 22 | 0.33 | 0.16 | 0.19 | 0.39 | 0.21 |
| 23 | 0.2 | 0.12 | 0.09 | 0.21 | 0.13 |
| 24 | 0.12 | 0.07 | 0.04 | 0.1 | 0.07 |
| 25 | 0.05 | 0.05 | 0.02 | 0.05 | 0.03 |
| 26 | 0 | 0.03 | 0.01 | 0.02 | 0.02 |
| 27 | 0 | 0.02 | 0 | 0.01 | 0.01 |
| 28 | 0 | 0.01 | 0 | 0 | 0 |
| TOTAL WT % NP | 13.26 | 7.31 | 15.03 | 15.96 | 11.5 |

The Cloud Filter Plugging Point ("CFFP") for the above Fuel samples A through E was then measured using ASTM D6371-17a—Standard Test Method for Cold Filter Plugging Point of Diesel and Heating Fuels ("D6371") to obtain a baseline CFFP. Then, various fuel additive packages were added to the Fuel samples A-E. All of the treat rates (ppm) in the following examples used commercial grade additives and included solvents. The additive packages had the claimed alkyne-coupled alkylphenols, hydrocarbyl-substituted amine detergents, and vinyl acetate terpolymers at multiple concentrations and combinations.

The additized fuel samples were then tested to measure the effects of the various additive packages on the fuel's CFPP and WASA performance using a modified method of ASTM D6371-17a ("modified D6371"). The purpose of the modified test method is to test not only the effects of the additives on CFPP, but also the effects the additives have on the tendency of the wax crystals that are formed to settle within the fuel, or WASA performance. For the modified D6371, each additized fuel sample is added to a separate 250 ml graduated cylinder. The samples are then heated and maintained at 40° C. for 1 hour. After the sample cools to room temperature, a sufficient amount of the sample (about 45 ml) is removed and an "initial" CFPP is measured and recorded using D6371. The graduated cylinders with the remaining sample are then placed in a cold chamber and cooled and maintained at −18° C. for 16 hours. After the 16-hour period, the samples are removed from the freezer and the top 80% (approximately 164 ml) is removed from the cylinder using a pipette and discarded. The graduated cylinders with the remaining bottom 20% of the fuel samples are then heated and maintained for an hour at 40-60° C. The samples are then cooled at room temperature and a "bottoms" CFPP is measured (in ° C.) and recorded using D6371.

The effects of various additive packages on Fuel A are shown in Table 4 below.

TABLE 4

| | Fuel A | | | | |
|---|---|---|---|---|---|
| Additive type | EX A baseline | EX A-1 | EX A-2 | EX A-3 | EX A-4 |
| | concentration of actives (ppm) | | | | |
| quaternized PIB-succinimide | 0 | 0 | 0 | 48 | 48 |
| $CH_2$-coupled $C_{24}$-$C_{28}$ phenol | 0 | 0 | 6 | 0 | 6 |
| vinyl acetate terpolymer | 0 | 366 | 569 | 366 | 366 |
| initial CFPP ° C. | −11 | −23 | −23 | −22 | −26 |
| bottoms CFPP ° C. | ≥−11 | −15 | −18 | −23 | −22 |

The effects of various additive packages on Fuel B are shown in Table 5 below.

TABLE 5

| | Fuel B | | | | |
|---|---|---|---|---|---|
| Additive type | EX B baseline | EX B-1 | EX B-2 | EX B-3 | EX B-4 |
| | concentration of actives (ppm) | | | | |
| quaternized PIB-succinimide | 0 | 0 | 0 | 48 | 91 |
| $CH_2$-coupled $C_{24}$-$C_{28}$ phenol | 0 | 0 | 6 | 0 | 11 |
| vinyl acetate terpolymer | 0 | 150 | 150 | 150 | 286 |
| initial CFPP ° C. | −17 | −18 | −33 | −18 | −35 |
| bottoms CFPP ° C. | — | −14 | −32 | −9 | −20 |

The effects of various additive packages on Fuel C are shown in Table 6 below.

TABLE 6

| | Fuel C | | | | |
|---|---|---|---|---|---|
| Additive type | EX C baseline | EX C-1 | EX C-2 | EX C-3 | EX C-4 |
| | concentration of actives (ppm) | | | | |
| quaternized PIB-succinimide | 0 | 0 | 0 | 48 | 48 |
| $CH_2$-coupled $C_{24}$-$C_{28}$ phenol | 0 | 0 | 6 | 0 | 6 |
| vinyl acetate terpolymer | 0 | 286 | 286 | 286 | 286 |
| initial CFPP ° C. | −14 | −21 | −22 | −22 | −22 |
| bottoms CFPP ° C. | −9 | −15 | −16 | −18 | −22 |

The effects of various additive packages on Fuel D are shown in Tables 7 and 8 below. The additive packages in Tables 7 and 8 differ in that the quaternized PIB-succinimide in the packages in Table 7 is replaced with an un-quaternized PIB-succinimide detergent in the packages in Table 8.

TABLE 7

| Additive type | Fuel D | | | | |
|---|---|---|---|---|---|
| | EX D baseline | EX D-1 | EX D-2 | EX D-3 | EX D-4 |
| | | concentration of actives (ppm) | | | |
| quatemized PIB-succinimide | 0 | 24 | 48 | 80 | 0 |
| $CH_2$-coupled $C_{24}$-$C_{28}$ phenol | 0 | 6 | 6 | 6 | 6 |
| vinyl acetate terpolymer | 0 | 365 | 365 | 365 | 500 |
| initial CFPP ° C. | −11 | −22 | −23 | −24 | −22 |
| bottoms CFPP ° C. | — | −19 | −20 | −22 | −13 |

Example D-4 shows that at least some hydrocarbyl-substituted detergent is useful to reduce CFPP of a fuel, even when the amount of the terpolymer is increased significantly. This shows the claimed additives may have a synergistic effect.

TABLE 8

| Additive type | Fuel D | | | | |
|---|---|---|---|---|---|
| | EX D-5 | EX D-6 | EX D-7 | EX D-8 | EX D-9 |
| | | concentration of actives (ppm) | | | |
| PIB-succinimide detergent | 54 | 54 | 24 | 48 | 80 |
| $CH_2$-coupled $C_{24}$-$C_{28}$ phenol | 6 | 11 | 6 | 6 | 6 |
| vinyl acetate terpolymer | 365 | 365 | 365 | 365 | 365 |
| initial CFPP ° C. | −22 | −24 | −23 | −22 | −23 |
| bottoms CFPP ° C. | −17 | −17 | −14 | −15 | −16 |

The effects of various additive packages on Fuel E are shown in Tables 9 and 10 below. The additive packages in Tables 9 and 10 differ in that the quaternized PIB-succinimide in the packages in Table 9 is replaced with an un-quaternized PIB-succinimide detergent in the packages in Table 10.

TABLE 9

| Additive type | Fuel E | | | | | |
|---|---|---|---|---|---|---|
| | EX E baseline | EX E-1 | EX E-2 | EX E-3 | EX E-4 | EX E-5 |
| | | concentration of actives (ppm) | | | | |
| quaternized PIB-succinimide | 0 | 54 | 24 | 48 | 9 | 80 |
| $CH_2$-coupled $C_{24}$-$C_{28}$ phenol | 0 | 11 | 6 | 6 | 0 | 6 |
| vinyl acetate terpolymer | 0 | 365 | 365 | 365 | 365 | 365 |
| initial CFPP ° C. | −15 | −35 | −35 | −36 | −32 | −36 |
| bottoms CFPP ° C. | −9 | −27 | −33 | −30 | −20 | −32 |

Example E-4 shows that at least some hydrocarbyl-substituted detergent and a dialkyl phenol are useful to reduce CFPP of a fuel. Example E-5 suggests there may be a threshold in the amount of hydrocarbyl-substituted detergent that is useful in reducing the CFPP.

TABLE 10

| Additive type | Fuel E | | | | |
|---|---|---|---|---|---|
| | EX E-6 | EX E-7 | EX E-8 | EX E-9 | EX E-10 |
| | | concentration of actives (ppm) | | | |
| PIB-succinimide detergent | 24 | 48 | 54 | 54 | 80 |

TABLE 10-continued

| Additive type | Fuel E | | | | |
|---|---|---|---|---|---|
| | EX E-6 | EX E-7 | EX E-8 | EX E-9 | EX E-10 |
| | | concentration of actives (ppm) | | | |
| $CH_2$-coupled $C_{24}$-$C_{28}$ phenol | 6 | 6 | 6 | 11 | 6 |
| vinyl acetate terpolymer | 365 | 365 | 365 | 365 | 365 |
| initial CFPP ° C. | −32 | −32 | −29 | −34 | −32 |
| bottoms CFPP ° C. | −27 | −29 | −31 | −31 | −30 |

An additional fuel additive, an ethoxylated alkyl amine as added to Fuel E to fuels to test its effect on the fuel's CFPP and WASA performance. The effects of various additive packages including the ethoxylated alkyl amine on Fuel E are shown in Table 11 below.

TABLE 11

| Additive type | Fuel E | | |
|---|---|---|---|
| | EX E-11 | EX E-12 | EX E-13 |
| | | actives (ppm) | |
| PIB-succinimide detergent | 54 | 54 | 0 |
| $CH_2$-coupled $C_{24}$-$C_{28}$ phenol | 6 | 6 | 6 |
| vinyl acetate terpolymer | 365 | 365 | 365 |
| ethoxylated alkyl amine | 14 | 45 | 46 |
| initial CFPP ° C. | −29 | −34 | −34 |
| bottoms CFPP ° C. | −29 | −34 | −22 |

Figure 2:
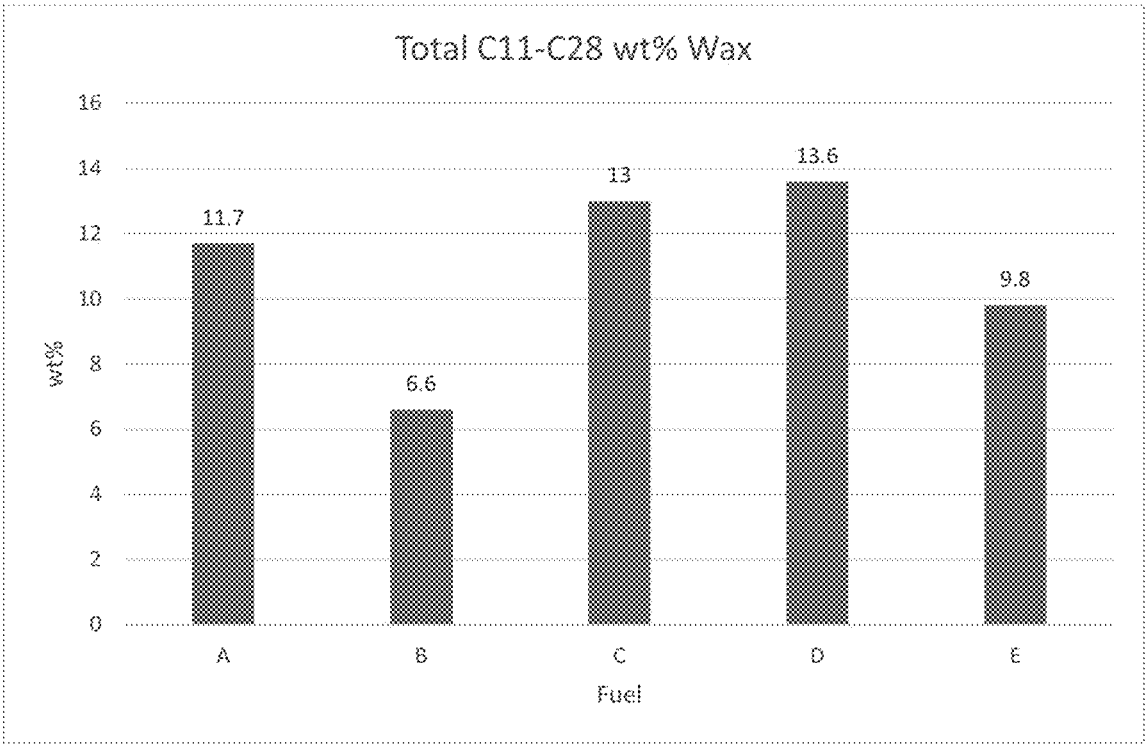
FIG. 2 shows the total normal $C_{11}$ to $C_{28}$ paraffin content of Fuels A to E.

FIG. 2 shows the total normal $C_{11}$ to $C_{28}$ paraffin content of Fuels A to E. The examples show that when the total normal $C_{11}$ to $C_{28}$ paraffin content of the fuel is at least 7 wt % as in Fuels A, C, D, and E, the claimed fuel additive components/compositions are particularly effect as compared when the total normal $C_{11}$ to $C_{28}$ paraffin content of the fuel is less than 7 wt % as in Fuel B. Accordingly, in one embodiment, the fuel composition comprises a fuel wherein the total normal $C_{11}$ to $C_{28}$ paraffin content of the fuel is at least 7 wt %.

Each of the documents and ASTM standards referred to above are incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A composition comprising:

a. at least one fuel that is a diesel fuel, a biodiesel fuel, or combinations thereof;

b. less than 100 ppmof an alkylene-coupled $C_{10}$ to $C_{60}$ alkylphenol;

c. 25 to 500 ppm of a terpolymer formed from ethylene, propylene, and vinyl acetate; and d. 5 to 90 ppm of hydrocarbyl-substituted amine detergent having at least one tertiary amino group wherein the fuel has a total normal paraffin content of at least 5 to 30 wt %, based on a total weight of the fuel and wherein the normal paraffin distribution is between $C_5$ to $C_{44}$ as measured by gas chromatography (ASTM D2887).

2. The composition of claim 1, wherein the alkylene-coupled alkylphenol is an alkylene-coupled $C_{24}$ to $C_{28}$ alkylphenol.

3. The composition of claim 2, wherein the alkylene-coupled $C_{24}$ to $C_{28}$ alkylphenol is an aldehyde-coupled phenolic resin.

4. The composition of claim 1, wherein the hydrocarbyl-substituted amine detergent is the reaction product of a. a hydrocarbyl-substituted acylating agent; and b. a nitrogen-containing compound having a nitrogen atom capable of reacting with the hydrocarbyl-substituted acylating agent.

5. The composition of claim 4, wherein the hydrocarbyl-substituted acylating agent is a hydrocarbyl-substituted succinic anhydride or hydrocarbyl-substituted succinic acid.

6. The composition of claim 5, wherein the hydrocarbyl-substituent is dodecenylene, hexadecenylene, butylene, isobutylene, polyisobutylene, or combinations thereof.

7. The composition of claim 6, wherein the hydrocarbyl-substituent is a polyisobutylene having a number average molecular weight ranging from 100 to 2300.

8. The composition of claim 1, wherein the hydrocarbyl-substituted amine detergent having at least one tertiary amino group (d.) is quaternized.

9. The composition of claim 8, wherein the hydrocarbyl-substituted amine detergent is quaternized with a quaternizing agent comprising at least one dialkyl sulfate, alkyl halide, hydrocarbyl substituted carbonate, hydrocarbyl epoxide, carboxylate, alkyl ester or combinations thereof.

10. The composition of claim 1, further having at least one other additive comprising a detergent, a dispersant, a demulsifier, a foam inhibitor, a lubricity agent, a cold flow improver, an antioxidant, a corrosion inhibitor, a cetane improver, a metal deactivator, a solvent, or a mixture thereof.

11. The composition of claim 1, further comprising an ethoxylated alkyl amine.

12. The composition of claim 1, wherein the fuel has a total normal paraffin content of at least 7 to 30 wt %, based on a total weight of the fuel and wherein the normal paraffin distribution is between $C_{11}$ to $C_{28}$ as measured by gas chromatography (ASTM D2887).

13. The composition of claim 1, wherein the cloud point temperature ("CP") of the fuel ranges from −17° C. to 14° C. as measured using ASTM test method D5773.

14. The composition of claim 1, wherein the cold filter plugging point ("CFPP") of the composition is at least 5° C. lower than the CFPP of the fuel as measured using ASTM D6371.

15. A method of reducing the cold filter plugging point ("CFPP") of a fuel, said method comprising adding the following components to said fuel:

a. less than 100 ppmof an alkylene-coupled $C_{10}$ to $C_{60}$ alkylphenol;

b. 25 to 500 ppm of a terpolymer formed from ethylene, propylene, and vinyl acetate; and c. 5 to 90 ppm, of a hydrocarbyl-substituted amine detergent having at least one tertiary amino group wherein the fuel has a total normal paraffin content of at least 5 to 30 wt %, based on a total weight of the fuel and wherein the normal paraffin distribution is between $C_5$ to $C_{44}$ as measured by gas chromatography (ASTM D2887).

16. The method of claim 15, wherein said fuel comprises at least one fuel that is a diesel fuel, a biodiesel fuel, or combinations thereof.

17. The method of claim 15, wherein the fuel has a total normal paraffin content of at least 7 to 30 wt %, based on a total weight of the fuel and wherein the normal paraffin distribution is between $C_{11}$ to $C_{28}$ as measured by gas chromatography (ASTM D2887).

18. The method of claim 15, wherein the cold filter plugging point ("CFPP") of the fuel with the components is at least 5° C. lower than the CFPP of the fuel without the components, as measured using ASTM D6371.

* * * * *